US006386004B2

(12) United States Patent
Salein

(10) Patent No.: US 6,386,004 B2
(45) Date of Patent: May 14, 2002

(54) LAUNDRY DRUM

(75) Inventor: Matthias Salein, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 09/888,024

(22) Filed: Jun. 22, 2001

Related U.S. Application Data

(63) Continuation of application No. PCT/EP99/09792, filed on Dec. 10, 1999.

(30) Foreign Application Priority Data

Dec. 22, 1998 (DE) ..... 198 59 571

(51) Int. Cl.[7] ..... D06F 21/10; D06F 37/04

(52) U.S. Cl. ..... 68/58

(58) Field of Search ..... 68/58

(56) References Cited

U.S. PATENT DOCUMENTS 3,201,958 A * 8/1965 Smith ..... 68/58
3,344,447 A * 10/1967 Candor et al. ..... 68/58 X
3,823,583 A * 7/1974 Stroberg et al. ..... 68/58

* cited by examiner

*Primary Examiner*—Philip R. Coe
(74) *Attorney, Agent, or Firm*—Herbert L. Lerner; Laurence A. Greenberg; Werner H. Stemer

(57) ABSTRACT

In a laundry drum, a liquid diverter includes a driver having a driver interior and a run-off ramp therein. The driver interior receives liquid scooped and lifted by the drum during rotation thereof. The driver discharges scooped liquid in its lifted position into the drum interior. The run-off ramp is oriented horizontally or has a descending gradient when the drum rotation axis is orientated in a direction deviating from horizontal and when the drum is in a rotary position in which the driver is in its highest position, and thereby, permits, in all of the drum's rotation directions, a flow of scooped liquid on the run-off ramp in a direction of a rising part of the rotation axis when in the driver's lifted position. The liquid is conducted into only part of the drivers in a case of low liquid level as a result of the inclination.

9 Claims, 1 Drawing Sheet

LAUNDRY DRUM

CROSS-REFERENCE TO RELATED APPLICATION

This application is a continuation of copending International Application No. PCT/EP99/09792, filed Dec. 10, 1999, which designated the United States.

BACKGROUND OF THE INVENTION

Field of the Invention

The invention lies in the field of appliances. The invention relates to an essentially cylindrical laundry drum that has at least one driver and that, during its rotation, scoops up and lifts liquid into the interior of the at least one driver. The at least one driver discharges the scooped liquid in a lifted position into the interior of the laundry drum.

To moisten the laundry more effectively during the washing operation, it has been customary for some time to provide the laundry drum with liquid lifting devices that, during their rotation, scoop up liquid from below, lift it, and sprinkle it in a lifted position on to the laundry inside the laundry drum. Drivers used for such a purpose are normally provided in any case for overturning the laundry inside the laundry drum. The liquid, that, for example, may be washing suds or rinsing water, is conducted by scooping devices into the drivers, is lifted by the drivers, and is sprinkled in a lifted position into the interior of the laundry drum. The scooping devices are typically disposed in the region of the drivers in the drum casing and scoop up liquid quantities, wetting the drum on the outside, through orifices in the casing and/or in the end faces of the drum into the drivers.

Such a laundry drum is disclosed, for example, from German Published, Non-Prosecuted Patent Application DE 37 12 118 A1. The method to be carried out with it can be used without difficulty in the case of cylindrical laundry drums with a horizontally oriented axis of rotation, in which the laundry drum is wetted by liquid along its entire depth between the end faces. In such a case, liquid can be scooped into the interior of a driver over the entire length of the latter and can be sprinkled over the entire depth of the laundry drum.

If, then, the axis of rotation of the laundry drum is oriented obliquely, it may happen that the laundry drum dips into the liquid only at one end and is not wetted by liquid over its entire depth, so that liquid can be scooped into the driver only in a restricted scooping region. Such a problem arises, in particular, when the liquid level in a tub surrounding the drum is low, as is generally desirable to reduce water consumption. The drivers then possibly contain in only one portion liquid that can be sprinkled inside the laundry drum over only a small area. In such cases, the liquid will, for the most part, be sprinkled in the vicinity of the further-down end of the oblique laundry drum and run along the laundry drum rear wall there, without being sprinkled on the laundry. The sprinkling of the laundry in the laundry drum over the depth of the laundry drum is, therefore, highly uneven in oblique laundry drums, so that laundry items distributed unfavorably in the laundry drum are sometimes not sprinkled or poorly sprinkled.

There is, in addition, the problem that the drivers, together with the drum, assume an oblique position that, while the drum rotates through a horizontal orientation in a mid-height position, is the same in the upper position again as the lower position. As such, the lifted liquid inside the drivers is held back in the lower portion into which it was conducted during scooping.

SUMMARY OF THE INVENTION

It is accordingly an object of the invention to provide a laundry drum that overcomes the hereinafore-mentioned disadvantages of the heretofore-known devices of this general type and that sprinkles the scooped liquid quickly over large areas of the laundry drum by drivers having conventional shapes.

With the foregoing and other objects in view, there is provided, in a substantially cylindrical laundry drum having a rotation axis, rotary positions, and rotation directions, the laundry drum scooping and lifting liquid into an interior of the laundry drum when rotated, in accordance with the invention, a liquid diverter, including at least one driver having a lifted position, a highest position, a driver interior, and at least one run-off ramp in the driver interior, the driver interior receiving liquid scooped and lifted by the laundry drum during rotation of the laundry drum, the at least one driver discharging scooped liquid in the lifted position into the interior of the laundry drum, and the at least one run-off ramp one of being oriented horizontally and having a descending gradient when the rotation axis is orientated in a direction deviating from horizontal and when the laundry drum is in a rotary position in which the at least one driver is in the highest position, and thereby, permits, in the rotation directions of the laundry drum, a flow of scooped liquid on the at least one run-off ramp in a direction of a rising part of the rotation axis when in the lifted position.

A laundry drum, in which the at least one driver has in its interior at least one run-off ramp that, when the axis of rotation of the laundry drum has an orientation deviating from the horizontal, in a rotary position of the laundry drum in which the at least one driver is in its highest position, is oriented horizontally or has a descending gradient in the direction in which the axis of rotation of the laundry drum rises, so that in both directions of rotation of the laundry drum, the scooped liquid flows in a lifted position on the at least one run-off ramp in the direction in which the axis of rotation of the laundry drum rises.

Thus, the lifted liquid can flow in the driver, on the run-off ramp, into a portion into which it has not been possible for any liquid to be scooped due to the restricted scooping region and, from there, can be sprinkled into the interior of the laundry drum. Thus, regardless of the scooping region, the interior of the laundry drum can be sprinkled essentially along its entire length, and, in particular, even at its end located further up.

In accordance with a further feature of the invention, the at least one run-off ramp has a descending gradient of at least 5° when the at least one driver is in its highest position during the rotation of the laundry drum. The run-off is thereby accelerated, so that a large quantity of liquid can be sprinkled in the short time in which the driver is in an upper position. Also, thereby, a flow of scooped liquid is permitted on the at least one run-off ramp in a direction of a rising part of the rotation axis when in the lifted position in all of the rotation directions of the laundry drum.

Even a run-off ramp that is oriented horizontally in the driver's highest position can improve the transport of liquid within the driver in its longitudinal direction because the lifted liquid can be distributed and finally sprinkled at the points where orifices are provided. In such cases, there may be provision for lowering the rotational speed of the drum for scooping and sprinkling to lengthen the time in which the liquid in the driver can be distributed and sprinkled. Furthermore, the run-off ramp can be made short, so that the liquid can reach the end of the latter quickly and be sprinkled downward there into the interior of the laundry drum. In any event, where oblique cylindrical laundry drums are concerned, a run-off ramp oriented horizontally in the upper position prevents a situation where the lifted quantity of liquid is held back in a lower portion of the driver.

Moreover, by disposing the run-off ramp inside the driver, the driver can be configured externally largely independently of the profile of the inner run-off ramp. In particular, the external shape of the drivers can be adapted to the requirements of the movement of the laundry in the drum, without influencing the function of the transport of liquid in the longitudinal direction of the driver or sprinkling. Thus, the drivers may even be configured in a conventional shape with a uniform height.

In accordance with another feature of the invention, there may be provision for a housing upper part of the at least one driver, the housing upper part to be located between the at least one run-off ramp and the axis of rotation of the laundry drum, to run essentially parallel to the axis of rotation of the laundry drum and, in particular, to have orifices at its end, so that a liquid flowing in a lifted position from the at least one run-off ramp onto the housing upper part flows back on the latter in the direction in which the axis of rotation of the laundry drum falls and at the same time flows through the orifices in the housing upper part into the interior of the laundry drum. Therefore, liquid flowing from the run-off ramp can be sprinkled over an area in a distributed manner, with a plurality of orifices accelerating the sprinkling.

In accordance with an added feature of the invention, between the at least one run-off ramp and the housing upper part may be disposed a partition that extends essentially transversely to the axis of rotation of the laundry drum. It is thereby possible to limit the runback and define the area in which the liquid that has flowed forward on the run-off ramp is sprinkled through the housing upper part.

In accordance with an additional feature of the invention, there may be formed between the at least one run-off ramp and the housing upper part, on a side of the partition that is located in the direction of a falling axis of rotation of the laundry drum, a chamber into which liquid can be scooped and out of which liquid can be discharged in a lifted position through the orifices of the housing upper part into the interior of the laundry drum. The chamber is delimited on the side located opposite the partition by a rear wall that has at least one orifice for filling with liquid. As a result, the space between the run-off ramp and the housing upper part can be utilized as a scooping chamber, and the scooped and lifted quantity of liquid can be increased.

In accordance with yet another feature of the invention, the at least one run-off ramp may have orifices through which lifted liquid can pass even during run-off on the at least one run-off ramp. Thus, the time required for sprinkling can be reduced.

In accordance with yet a further feature of the invention, at least one driver may have in the longitudinal direction a plurality of portions that adjoin one another and that each have a run-off ramp. Advantageously, the lined-up portions extend together over the entire depth of the laundry drum. In such a case, the individual run-off ramps, which extend upward from the base of the driver at a specific angle dependent on the inclination of the laundry drum and on the desired run-off gradient, become shorter. Accordingly, the overall height of the driver can be reduced by a plurality of successive run-off ramps.

In accordance with yet an added feature of the invention, the at least one run-off ramp has a base, an end remote from the base, and the orifices are disposed at the end remote from the base.

In accordance with a concomitant feature of the invention, the at least one driver has a longitudinal axis and portions disposed along the longitudinal axis adjoining one another, and each of the portions has a run-off ramp.

Other features that are considered as characteristic for the invention are set forth in the appended claims.

Although the invention is illustrated and described herein as embodied in a laundry drum, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
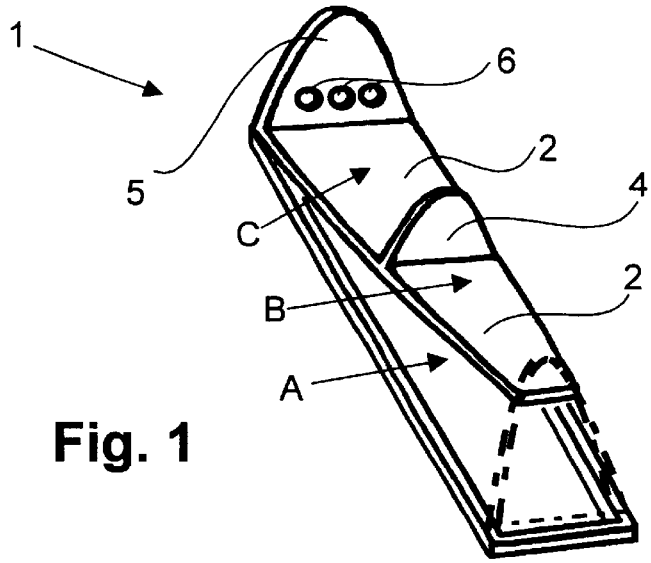
FIG. 1 is a perspective view of a portion of a driver according to the invention with the housing upper part removed.

In all the figures of the drawing, sub-features and integral parts that correspond to one another bear the same reference symbol in each case.

Referring now to the figures of the drawings in detail and first, particularly to FIG. 1 thereof, there is shown a driver 1 without a housing upper part 3, for use in a laundry drum 7 according to the invention. The driver 1 in the exemplary embodiment has two identical portions of the type illustrated that are disposed one behind the other. The base of the driver 1 is cut out to make it possible for liquid 9 to be conducted into the casing of the laundry drum by scooping devices. Disposed inside the driver 1 is a run-off ramp 2 that extends upward at a low angle and below which is located a chamber A. Liquid 9 is scooped into the chamber A during the rotation of the laundry drum when the driver 1 is in a lower position. The run-off ramp 2 preferably has a descending gradient of at least 5° when the driver 1 is in its highest position during the rotation of the laundry drum. The scooping devices may be conventional type and are not illustrated for the sake of clarity. Disposed on the top side of the run-off ramp 2, approximately in the middle of the portion, is a partition 4 that extends upward essentially perpendicularly to the base of the driver 1. Disposed at the rear end of the illustrated portion of the driver 1 is a vertical rear wall 5 with orifices 6 that, together with the partition 4, the top side of the run-off ramp 2, and the housing upper part 3 (see FIG. 2), delimits a chamber C. During scooping, liquid 9 passes into the chamber C through the orifices 6. Located on that side of the partition 4 that faces away from the rear wall 5 is a chamber B that is likewise delimited by the top side of the run-off ramp 2 and the housing upper part 3 (see FIG. 2). The front end of the illustrated portion is followed either by a further portion with its rear wall 5 or by an end plate of the laundry drum 7.

Figure 2:
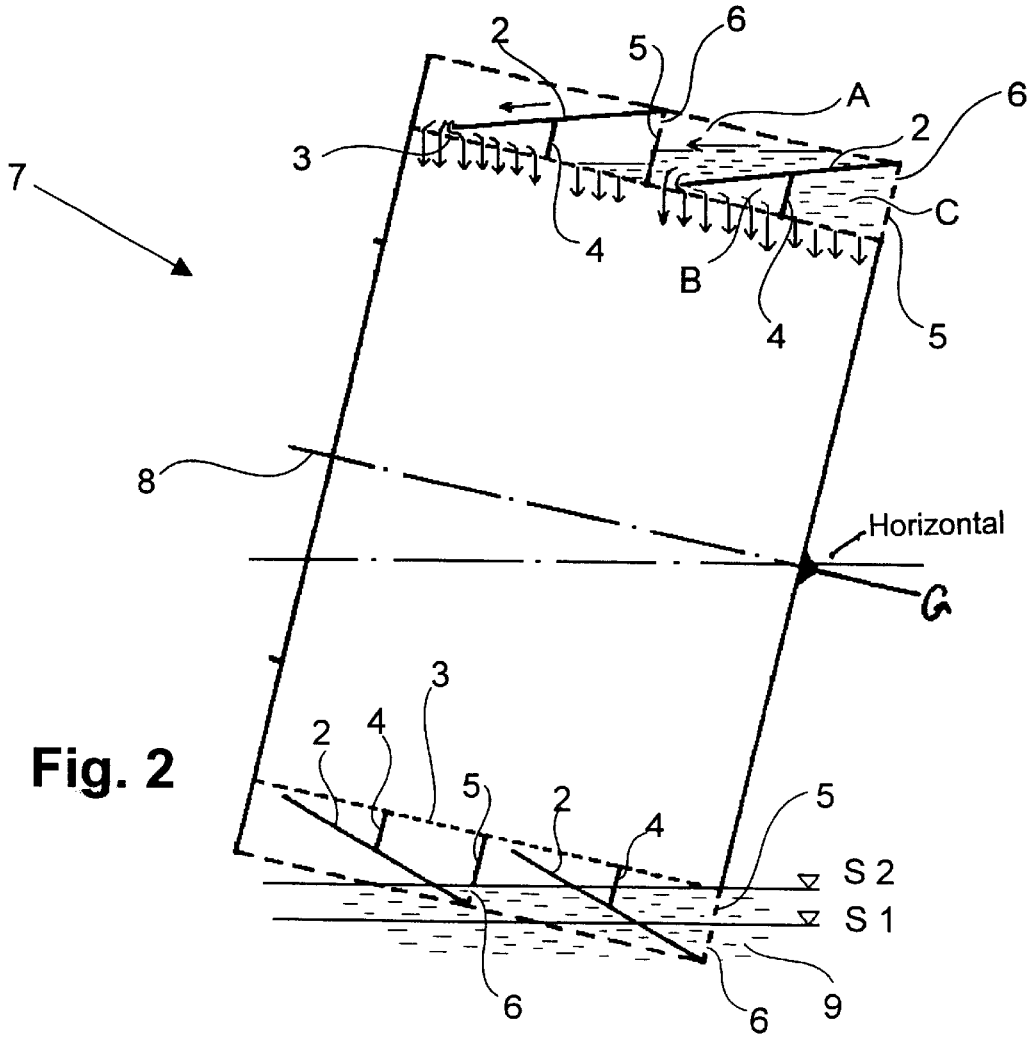
FIG. 2 is a cross-sectional view of a laundry drum according to the invention.

FIG. 2 illustrates a cross-section of a laundry drum 7 according to the invention with an inclined axis of rotation 8. Due to the inclination of the drum shown, the laundry drum 7 penetrates only with its right end into the liquid 9.

Accordingly, depending on how far the laundry drum 7 penetrates into the liquid 9, during scooping the driver 1 is filled with liquid 9 over only part of its length. In the case of the lower liquid level S1, only the chambers C and A of the right portion located further down are filled with liquid 9. By contrast, at the liquid level S2, the chambers A and C of the left portion located further up are additionally filled with liquid 9, to an albeit smaller extent. The chambers A are filled through orifices in the casing 3 of the laundry drum, whereas the chambers C are filled through the orifices 6 in the rear walls 5, the rear wall 5 of the portion located on the right being at the same part of the right end plate of the laundry drum 7.

During the further rotation of the laundry drum, then, the driver 1 lifts the scooped liquid 9. In the exemplary embodiment described, the sprinkling operation is described with reference to the other driver 1 that is illustrated in its highest position, although the operation may commence even earlier and, depending on the rotational speed of the drum, proceed even until after the highest position is exceeded. In the position located above half the drum diameter, then, liquid 9 located in the chambers A begins to flow to the left on the run-off ramp 2 due to the descending gradient that is established. At the end of the run-off ramp 2, it flows downward in the chamber B onto the housing upper part 3 provided with orifices. On the inside of the housing upper part 3, the liquid 9 flows back again to the right, and it is sprinkled in a distributed manner into the interior of the laundry drum 7 through the orifices in the housing upper part 3. As in the case of conventional scooping drivers, a liquid 9 located in the chambers C is sprinkled directly through the orifices in the housing upper part 3 into the interior of the laundry drum.

By virtue of the solution according to the invention, the drum interior can thereby be sprinkled and liquid can be distributed over the entire depth of the drum and more uniformly in the drum interior even when the scooping region in the axial direction of the drum is restricted. The more efficient distribution occurs in spite of the fact that the external shape of the driver is not modified or is modified only slightly.

I claim:

1. In a substantially cylindrical laundry drum having a rotation axis, rotary positions, and rotation directions, the laundry drum scooping and lifting liquid into an interior of the laundry drum when rotated, a liquid diverter, comprising:

at least one driver having a lifted position, a highest position, a driver interior, and at least one run-off ramp in said driver interior;

said driver interior receiving liquid scooped and lifted by the laundry drum during rotation of the laundry drum;

said at least one driver discharging scooped liquid in said lifted position into the interior of the laundry drum; and said at least one run-off ramp one of being oriented horizontally and having a descending gradient when the rotation axis is orientated in a direction deviating from horizontal and when the laundry drum is in a rotary position in which said at least one driver is in said highest position, and thereby, permits, in the rotation directions of the laundry drum, a flow of scooped liquid on said at least one run-off ramp in a direction of a rising part of the rotation axis when in said lifted position.

2. The laundry drum according to claim 1, wherein said at least one run-off ramp has a descending gradient of at least 5° when the rotation axis is orientated in a direction deviating from horizontal and when the laundry drum is in a rotary position in which said at least one driver is in said highest position, and, thereby, permits, in the rotation directions of the laundry drum, a flow of scooped liquid on said at least one run-off ramp in a direction of a rising part of the rotation axis when in said lifted position.

3. The laundry drum according to claim 1, wherein:

said at least one driver has a housing upper part disposed between said at least one run-off ramp and the rotation axis;

said housing upper part runs substantially parallel to the rotation axis and has orifices to permit, in a lifted position of said at least one driver, a liquid flowing from said at least one run-off ramp onto said housing upper part to flow back on said housing upper part in a direction in which the axis of rotation of the laundry drum falls and, at the same time, to flow through said orifices into the interior of the laundry drum.

4. The laundry drum according to claim 3, wherein:

said at least one driver has a partition disposed between said at least one run-off ramp and said housing upper part; and said partition extends substantially transverse to the rotation axis.

5. The laundry drum according to claim 4, wherein:

said partition has a side disposed in a direction of a falling axis of rotation of the laundry drum;

said at least one run-off ramp and said housing upper part form a chamber therebetween on said side of said partition;

said at least one driver has a rear wall with at least one orifice for filling said chamber with liquid;

said chamber is delimited on a side located opposite the partition by said rear wall; and liquid is to be scooped into said chamber and is to be discharged out of said chamber in said lifted position of said at least one driver through said at least one orifice and said orifices of said housing upper part into the interior of the laundry drum.

6. The laundry drum according to claim 1, wherein said at least one run-off ramp has orifices through which lifted liquid can pass during run-off on said at least one run-off ramp.

7. The laundry drum according to claim 6, wherein:

said at least one run-off ramp has a base, an end remote from said base; and said orifices are disposed at said end remote from said base.

8. The laundry drum according to claim 1, wherein:

said at least one driver has a longitudinal axis and portions disposed along said longitudinal axis adjoining one another; and each of said portions has a run-off ramp.

9. A liquid diverter for a substantially cylindrical laundry drum containing a liquid, comprising:

at least one driver having a lifted position, a highest position, a driver interior, and at least one run-off ramp in said driver interior;

said driver interior receiving liquid scooped and lifted by a laundry drum during rotation of the laundry drum about a rotation axis in rotation directions;

said at least one driver discharging scooped liquid in said lifted position into the interior of the laundry drum; and said at least one run-off ramp one of being oriented horizontally and having a descending gradient when the rotation axis is orientated in a direction deviating from horizontal and when the laundry drum is in a rotary position in which said at least one driver is in said highest position, and thereby, permits, in the rotation directions of the laundry drum, a flow of scooped liquid on said at least one run-off ramp in a direction of a rising part of the rotation axis when in said lifted position.

* * * * *